United States Patent [19]

Adrian et al.

[11] Patent Number: 4,632,440

[45] Date of Patent: Dec. 30, 1986

[54] DEVICE FOR LOCKING A MOBILE PANEL WITH DOUBLE SECURITY

[75] Inventors: Robert Adrian, Salon; Maurice Goulin, Lambesc, both of France

[73] Assignee: Societe Nationale Industrielle et Aerospatiale, Paris, France

[21] Appl. No.: 683,170

[22] Filed: Dec. 18, 1984

[30] Foreign Application Priority Data

Dec. 19, 1983 [FR] France ..... 8320285

[51] Int. Cl.[4] ..... E05C 3/04

[52] U.S. Cl. ..... 292/229; 70/DIG. 58; 292/210; 292/304

[58] Field of Search ..... 292/229, 129, 108, 210, 292/341.12, 302, 304, DIG. 40, DIG. 31; 70/DIG. 58

[56] References Cited

U.S. PATENT DOCUMENTS

| | | | |
|---|---|---|---|
| 2,717,796 | 9/1955 | Cudney | 292/229 |
| 3,240,523 | 3/1966 | Heimann | 292/210 X |
| 3,250,558 | 5/1966 | McClintock | 292/229 |
| 3,425,727 | 2/1969 | Swanson | 292/129 |
| 3,660,996 | 5/1972 | Syvertson | 70/DIG. 58 X |
| 3,888,096 | 6/1975 | Huss | 70/DIG. 58 X |
| 4,365,831 | 12/1982 | Bourne | 292/229 |
| 4,413,849 | 11/1983 | Davis et al. | 292/229 |
| 4,474,492 | 10/1984 | Fleitas | 292/304 X |
| 4,538,843 | 9/1985 | Harris | 292/DIG. 31 X |
| 4,548,435 | 10/1985 | Bourne | 292/229 |

FOREIGN PATENT DOCUMENTS

| | | | |
|---|---|---|---|
| 24573 | of 1909 | United Kingdom . | |
| 300411 | 11/1928 | United Kingdom | 292/DIG. 40 |

*Primary Examiner*—Robert L. Wolfe
*Assistant Examiner*—Russell W. Illich
*Attorney, Agent, or Firm*—Dennis P. Clarke

[57] ABSTRACT

Device for locking a cowl with double security, comprising panel securing means, constituted by a plate integral with the panel and having a conical hole, as well as by a conical stop integral with the fixed structure and which enters the plate hole when the panel is in the closed position. Locking means are constituted by a locking bush or flange integral with the fixed structure, a support mounted on the panel, a bolt mounted in pivotable manner on the support and able to engage in the locking bush when the panel is in the closed position. Elastic means draw the bolt towards the disengaged position of the locking bush. A pawl mounted on the support locks the bolt in the engaged position.

1 Claim, 4 Drawing Figures

DEVICE FOR LOCKING A MOBILE PANEL WITH DOUBLE SECURITY

BACKGROUND OF THE INVENTION

The invention relates to a device for locking a mobile panel with double security. More specifically the invention relates to a device for locking a mobile panel, which incorporates a securing device in the three axes of a locked panel incorporated into the double security locking mechanism, as well as a clearly visible indicator of the correctly locked position.

The known locking devices for mobile panels such as helicopter engine cowls are not completely satisfactory, because they do not positively ensure the securing of the cowl with respect to the bearing structure. This, vibrations frequently lead to deterioration and damage, as well as to clearances leading to untimely opening in flight and consequently to serious accident risks.

SUMMARY OF THE INVENTION

The present invention relates to a locking device preventing the opening of the mobile panel and which secures it in three axes, thereby preventing displacements induced by vibrations and which would lead to deterioration as a result of wear, friction, caulking, etc. It incorporates a safety of security system which, if the locking system fails, prevents the opening of the panel. It also enables the operator to be absolutely sure that the locking process is complete.

According to the invention, these functions are ensured through the presence, in the locking device, of means for securing the panel in its plane and means ensuring its maintainance in a locked position in a direction perpendicular to said plane, the securing means comprising a plate integral with the panel and having a conical hole, as well as a conical stop integral with the fixed structure and which enters the plate hole when the panel is in the closed position, said means for maintaining in the locked position being constituted by a locking bush or locking flange integral with the fixed structure, a support mounted on the panel, a bolt mounted in pivotal manner on the support and able to engage in the locking bush when the panel is in the closed position, elastic means drawing the bolt towards the disengaged position of the locking bush and a pawl mounted in pivotal manner on the support and able to lock the bolt in the engaged position, elastic means moving the pawl into the locking position.

The invention has the advantage of securing the articulated panel in the three axes, of absorbing displacements induced by vibrations and of not causing stresses in the panel during the closing thereof.

According to a preferred feature, the device has means for the safety locking of the bolt and for the visual display of the locked position of the complete device. These means comprise a safety or security cover mounted in pivotal manner on the support, said cover being able to prevent the manipulation of the bolt and the pawl, whereby this cover can only be pulled down if the bolt and the pawl are in the locked position.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
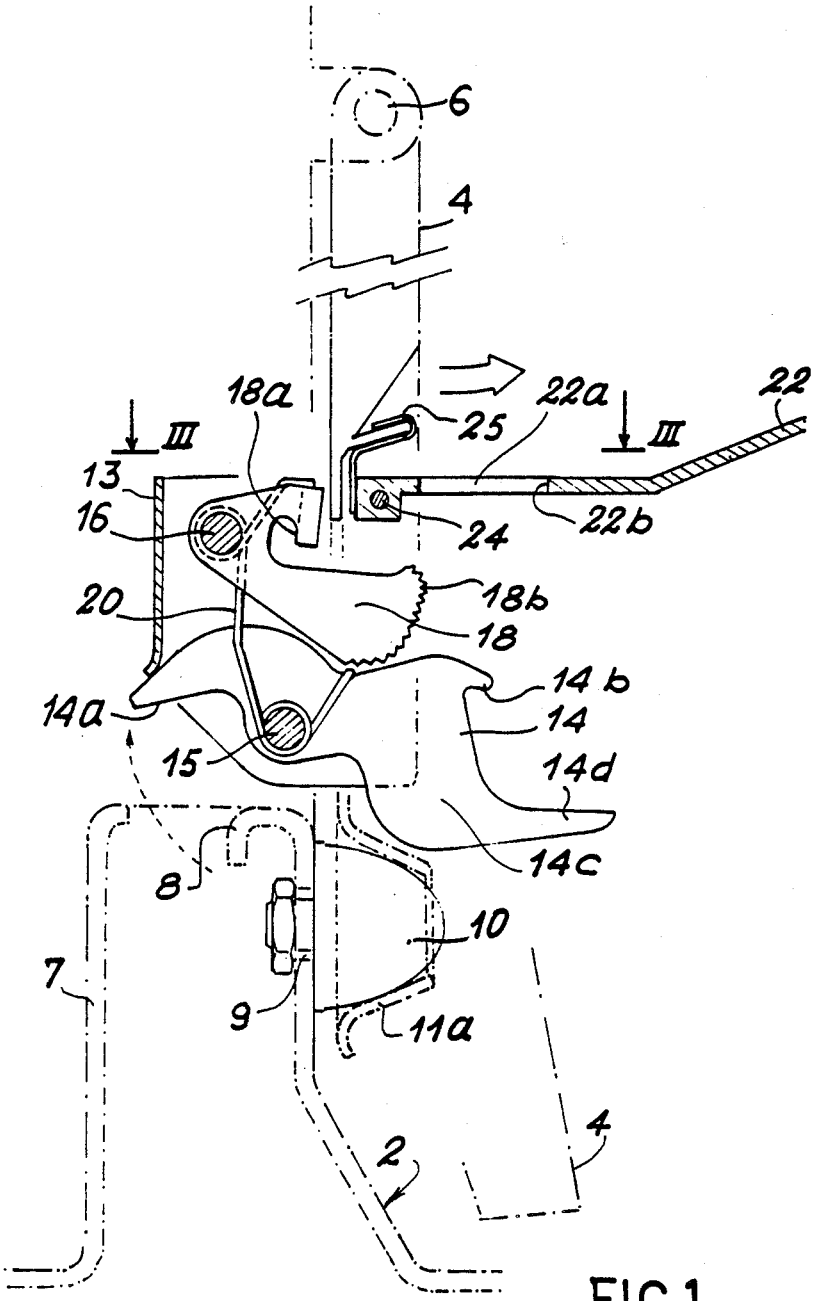
FIG. 1 a side view in the open position of a locking device for a mobile panel with double security according to the invention.

In FIG. 1, reference numeral 2 designates a structure, such as e.g. an aircraft or helicopter frame. A cowl 4 is articulated to frame 2 by a joint 6. Cowl 4 is e.g. an opening panel, an engine cowling or a flap.

The fixed structure 2 has a post 7, in the upper part of which is provided a locking flange or locking bush 8. In the upper part of post 7 and namely on the outer face thereof is provided an elastomeric conical stop 10, fixed to the post by means of a screw and a nut. Bore 9 made in the post has a diameter larger than that of the screw, which makes it possible to regulate the locking device by acting on the position of the stop, whose pin or spindle is mounted with the necessary clearance in the bore 9 made in the post.

The locking device has a plate 11 in the form of a thin sheet, e.g. a steel sheet, having a generally rectangular shape and having a rectangular central window. In its upper part, it has a flange 11*d* used for fixing a spring, in the way described hereinafter. In its lower part, it has a flanged edge conical hole 11*a*. For example, the cone angle is 60°. Hole 11*a* is matched to the conical stop 10, which is used for securing the device prior to locking. Plate 11 is fitted on to the stop by means of hole 11*a* and secures the mobile panel 4 in its plane. The plate is fixed to the mobile panel 4 by four bolts, whereof two are diagrammatically indicated by the axis line 12 in FIGS. 2*a* and 3.

Figure 2:
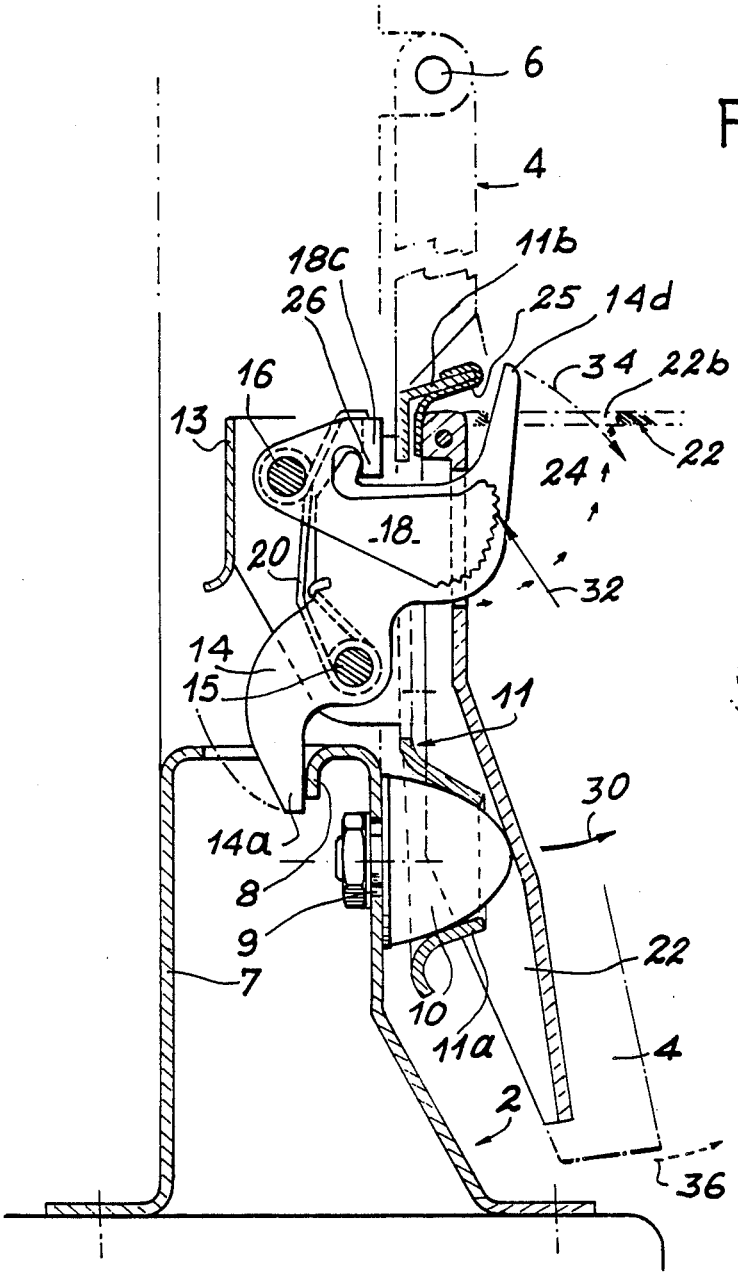
FIG. 2 the locking mechanism of FIG. 1 in the closed position.
Figure 2A:
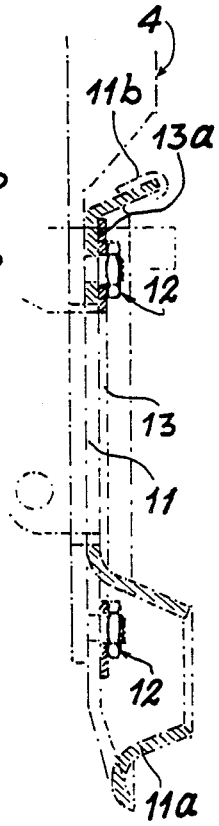
FIG. 2*a* a diagrammatic sectional view of the mobile panel, to which the plate is fixed.
Figure 3:
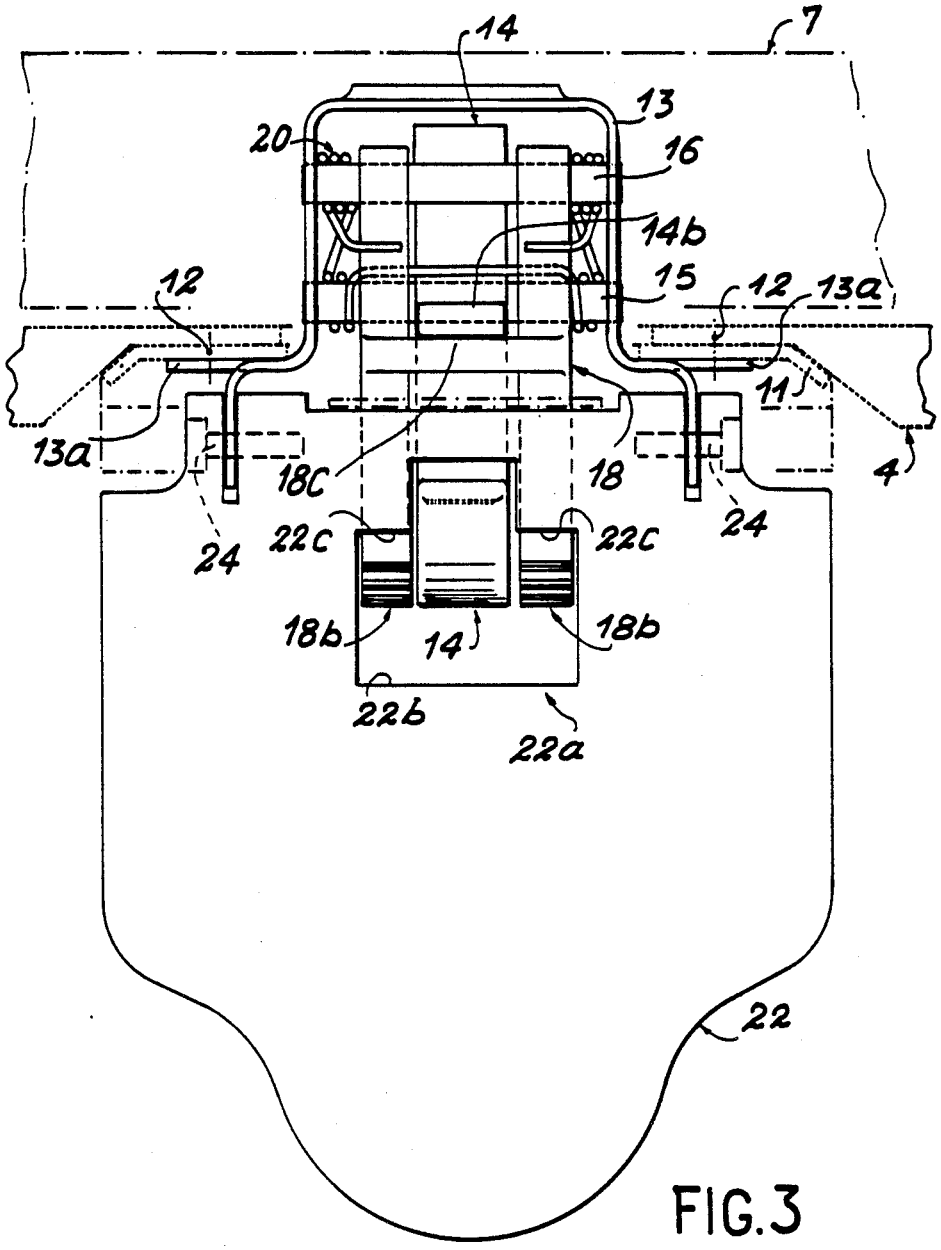
FIG. 3 a plan view in section along line III—III of FIG. 1 of the locking mechanism shown in FIGS. 1 and 2, the cover being in the raised position.

A box or support 13 engages in the rectangular window made in plate 11, on which it bears by the lateral edges 13*a* shown in FIGS. 2*a* and 3*a*. Support 13 is fixed to the mobile panel—plate assembly 4 by the same bolts 12 and ensures the fixing of the plate to the panel, as can be more particularly seen in FIGS. 2*a* and 3.

A bolt 14 is mounted in pivotal manner on support 13 by means of a pin or spindle 15. The bolt has a first surface 14*a* for retaining the cowl and which comes into contact with the locking flange 8, a second surface 14*b* for locking the bolt and a third safety locking surface 14*c*. It also has a control handle 14*d* enabling it to be pushed upwards into the closed position.

A pawl 18 is mounted in pivotal manner on support 13 by means of a pin or spindle 16 parallel to the pin or spindle 15. As can be seen in FIG. 3, pawl 18 comprises two parts which are symmetrical with respect to the axis of symmetry of the locking device and which are located on either side of bolt 14. These two parts are interconnected by a transverse bar 18*c* (cf. FIG. 2). Each symmetrical part has a locking surface 18*a* able to cooperate with locking surface 14*b* of the bolt. This surface is shaped like a notch. When the locking device is in the closed position, as shown in FIG. 2, surface 14*b* is engaged in notch 18*a* of the pawl. Moreover, each symmetrical part has an actuation surface 18*b* enabling it to be manually pivoted from one side about its pin 16 by an action in the direction of arrow 32 (FIG. 2). Surfaces 18*b* are serrated in order to facilitate unlocking.

Elastic return or restoring means are provided for drawing the bolt 14 into the open position, i.e. for rotating it in the clockwise direction in FIGS. 1 and 2. Elastic return or restoring means are also provided for rotating pawl 18 in the clockwise direction in FIGS. 1 and 2. In the embodiment described, these elastic means comprise a single safety spring 20, which exerts an elastic return action both on the bolt and on the pawl.

The locking device also comprises safety locking means, which are constituted by a safety or security cover 22 mounted so as to pivot about a hinge 24 integral with support 13 (cf. FIG. 3) and whose axis is parallel to pins 15 and 16. A leaf spring 25 fixed to flange 11*b* of plate 11 keeps the cover 22 in the open or closed position. In its closed position, the cover rests on the conical stop 10. It has an inverted T-shaped window 22*a*, whereof the lower edge 22*b* (Cf. FIG. 3) cooperates with the surface 14*c* of the bolt in order to lock the latter in the closed position when the cover is pulled down, as shown in FIG. 2. Surfaces 22*a* prevent the pivoting of the pawl when the cover is pulled down. The inner face of the cover is painted with a conspicuous colour, e.g. bright red.

In order to unlock the mechanism, it is firstly necessary to raise cover 22, by pivoting it about its rotation axis in the direction of arrow 30, in order to bring it into the position shown in FIG. 1. When this has been done, action takes place in the control surface 18*b* of the pawl, as indicated by arrow 32. This action brings about the pivoting of the pawl about its axis, as indicated by arrow 26 and releases the bolt, which pivots in the direction of arrow 34 under the action of elastic return means. It is then possible to raise the cowl, in the manner indicated by the dotted line arrow 36.

Locking takes place in the reverse order. With the panel 4 in the closed position and in contact with conical stop 10, action takes place on the control handle 14*d* of the bolt, so as to pivot the latter in the opposite direction to arrow 34 until attachment takes place with pawl 18. The bolt is then maintained in the locked position, as shown in FIG. 2. If the movement has not been completed, it automatically returns to the position shown in FIG. 1, thus incomplete locking is clearly visible. If locking has completely taken place, the security cover 22 is pulled down and is kept closed under the action of leaf spring 25. In this position, any action on the serrated part 18*b* of the pawl or on the bolt 14 has no effect on the mechanism.

Thus, the locking device according to the invention represents the combination of a single fixing member for securing a mobile panel relative to a fixed structure in three axes with, on the one hand, a double security locking of closure and, on the other hand, a clearly visible indication that satisfactory locking has taken place.

What is claimed is:

1. In a fixed structure having a mobile panel pivotedly fixed on said structure, said panel being mobile between an opened position and a closed position, a device for locking said mobile panel, comprising a plate integral with the panel and having a conical hole, as well as a conical stop integral with the fixed structure and which enters the plate hole when the panel is in the closed position, said device further comprising a locking bush or locking flange integral with the fixed structure, a support mounted on the panel, a bolt mounted in pivotal manner on the support and able to engage in the locking bush when the panel is in said closed position, elastic means drawing the bolt towards a disengaged position of the locking bush and a pawl mounted in pivotal manner on the support and able to lock the bolt in an engaged position, elastic means moving the pawl into said locking position thereof, a safety cover mounted in pivotal manner on the support, said cover being able to prevent the manipulation of the bolt and the pawl, wherein the safety cover has a window, whereof one face locks the active locking surface of the bolt, when the latter is in the closed position.

* * * * *